United States Patent [19]

Yoshino

[11] Patent Number: 4,732,595

[45] Date of Patent: Mar. 22, 1988

[54] OXYGEN GAS PRODUCTION APPARATUS

[75] Inventor: Akira Yoshino, Osaka, Japan

[73] Assignee: Daidousanso Co., Ltd., Osaka, Japan

[21] Appl. No.: 49,864

[22] PCT Filed: Aug. 8, 1986

[86] PCT No.: PCT/JP86/00410

§ 371 Date: Apr. 10, 1987

§ 102(e) Date: Apr. 10, 1987

[87] PCT Pub. No.: WO87/01185

PCT Pub. Date: Feb. 26, 1987

[30] Foreign Application Priority Data

Aug. 23, 1985 [JP] Japan ..... 60-186313

[51] Int. Cl.[4] ..... F25J 3/00

[52] U.S. Cl. ..... 62/11; 62/18; 62/37; 62/42

[58] Field of Search ..... 62/9, 11, 32, 36, 37, 62/38, 39, 40, 41, 42, 18

[56] References Cited

U.S. PATENT DOCUMENTS

| | | | |
|---|---|---|---|
| 2,940,269 | 6/1960 | Frainier | 62/38 |
| 3,039,274 | 6/1962 | Matsch | 62/11 |
| 3,735,599 | 5/1973 | Izumichi et al. | 62/18 |
| 4,526,595 | 7/1985 | McNeil | 62/39 |
| 4,529,425 | 7/1985 | McNeil | 62/39 |

*Primary Examiner*—Ronald C. Capossela
*Attorney, Agent, or Firm*—Armstrong, Nikaido, Marmelstein & Kubovcik

[57] ABSTRACT

The apparatus comprises an oxygen gas production apparatus comprising an air compression means for compressing air from an outside source, a purification means for removing carbon dioxide gas and water vapor from the air compressed by said air compression means, a heat exchange means for chilling the compressed air from said purification means to a cryogenic temperature, a fractionation column for liquefying and fractionating the compressed air chilled to a cryogenic temperature by said heat exchange means and holding nitrogen in gaseous state and oxygen in liquid state, a liquid oxygen storage means for receiving liquid oxygen from an outside source and storing the same, a line for introducing into said fractionation column the liquid oxygen from said liquid oxygen storage means as the refrigerant for liquefaction of compressed air, a liquid level detection-control means for monitoring the liquid level of oxygen held in said fractionation column and controlling the amount of feed of liquid oxygen from said liquid oxygen storage means in response to changes in said liquid level, a second line for guiding gaseous nitrogen in said fractionation column to said heat exchange means as a refrigerant, an expansion means for cooling the gaseous nitrogen in said second line by the principle of adiabatic expansion, and an oxygen gas withdrawal line for guiding the liquid oxygen in said fractionation column to said heat exchange means as a refrigerant and withdrawing the gaseous oxygen produced by heat exchange as a product oxygen gas.

1 Claim, 3 Drawing Figures

OXYGEN GAS PRODUCTION APPARATUS

BACKGROUND OF THE INVENTION

1. Field of the Invention

The present invention relates to an oxygen gas production apparatus by which high purity gaseous oxygen can be expediently produced.

2. Description of the Prior Art

It is customary to produce oxygen gas in an air fractionation plant which separates oxygen from nitrogen by taking advantage of their difference in boiling point. This conventional air fractionation plant is provided with an expansion turbine for generating the refrigeration necessary for the liquefaction and fractionation of air, which utilizes the Joule-Thomson effect due to adiabatic expansion.

However, because of its extremely high speed (tens of thousand revolutions per minute), the expansion turbine cannot delicately follow variations in demand load (variations in the rate of withdrawal of product oxygen gas). Thus, it is technically difficult to vary the rotational speed of the expansion turbine quickly and accurately in response to changes in the demand for product oxygen gas so as to maintain the compressed material air at a constant temperature at all times. As a result, a variation is inevitable in the purity of product oxygen gas, for low purity oxygen is frequently outputted to depress the overall purity of product oxygen.

OBJECT OF THE INVENTION

Having been accomplished in view of the above-described situation, the present invention aims at providing an oxygen gas production apparatus which is adapted to follow variations in load so that the purity of product oxygen gas may be kept constant.

SUMMARY OF THE INVENTION

The present invention is therefore directed to an oxygen gas production apparatus comprising an air compression means for compressing air from an outside source, a purification means for removing carbon dioxide gas and water vapor from the air compressed by said air compression means, a heat exchange means for chilling the compressed air from said purification means to a cryogenic temperature, a fractionation column for liquefying and fractionating the compressed air chilled to a cryogenic temperature by said heat exchange means and holding nitrogen in gaseous state and oxygen in liquid state, a liquid oxygen storage means for receiving liquid oxygen from an outside source and storing the same, a line for introducing into said fractionation column the liquid oxygen from said liquid oxygen storage means as the refrigerant source for liquefaction of compressed air, a liquid level detection-control means for monitoring the liquid level of oxygen held in said fractionation column and controlling the amount of feed of liquid oxygen from said liquid oxygen storage means in response with changes in said liquid level, a second line for guiding gaseous nitrogen in said fractionation column to said heat exchange means as a refrigerant, an expansion means for cooling the gaseous nitrogen in said second line by the principle of adiabatic expansion, and an oxygen gas withdrawal line for guiding the liquid oxygen in said fractionation column to said heat exchange means as a refrigenant and withdrawing the gaseous oxygen produced by heat exchange as a product oxygen gas. Having the above construction, the present invention affords the following advantages. The oxygen gas production apparatus according to the present invention comprises both an expansion means and a means for feeding liquid oxygen for refrigeration from an external source. The expansion means, which is by nature difficult to operate at a speed varying in quick response to changes in load, is driven at a constant speed at all times so as to maintain its cooling capacity at a constant level, while the amount of feed of liquid oxygen from the liquid oxygen storage means is controlled by means of the liquid level detection-control means to adjust the output of oxygen gas, so that the apparatus can adapt itself quickly to changes in the demand for product oxygen gas without detracting from the purity of product oxygen gas.

BRIEF DESCRIPTION OF THE DRAWINGS

In the accompanying drawings.

DETAILED DESCRIPTION OF THE INVENTION AND DESCRIPTION OF ITS PREFERRED EMBODIMENT

The present invention is described in detail hereinafter.

Figure 1:
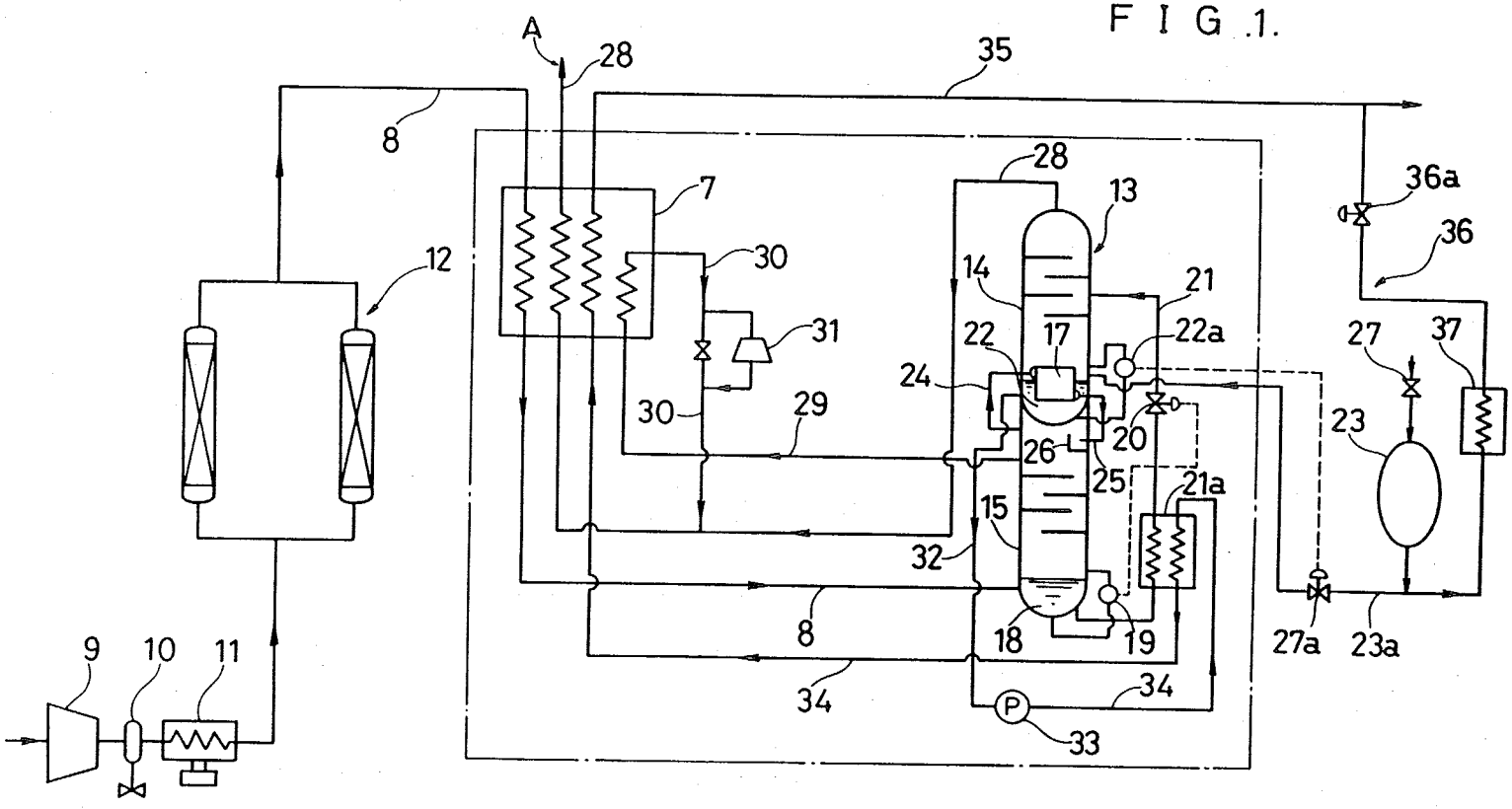
FIG. 1 is an elementary view showing a preferred embodiment of the present invention.
Figure 2:
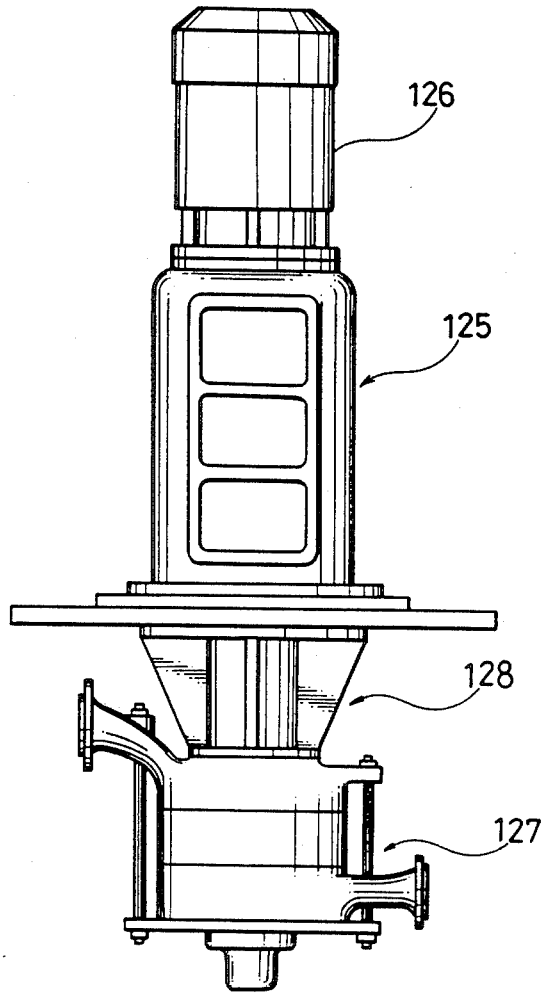
FIG. 2 is a plan view showing the pressurizing pump.
Figure 3:
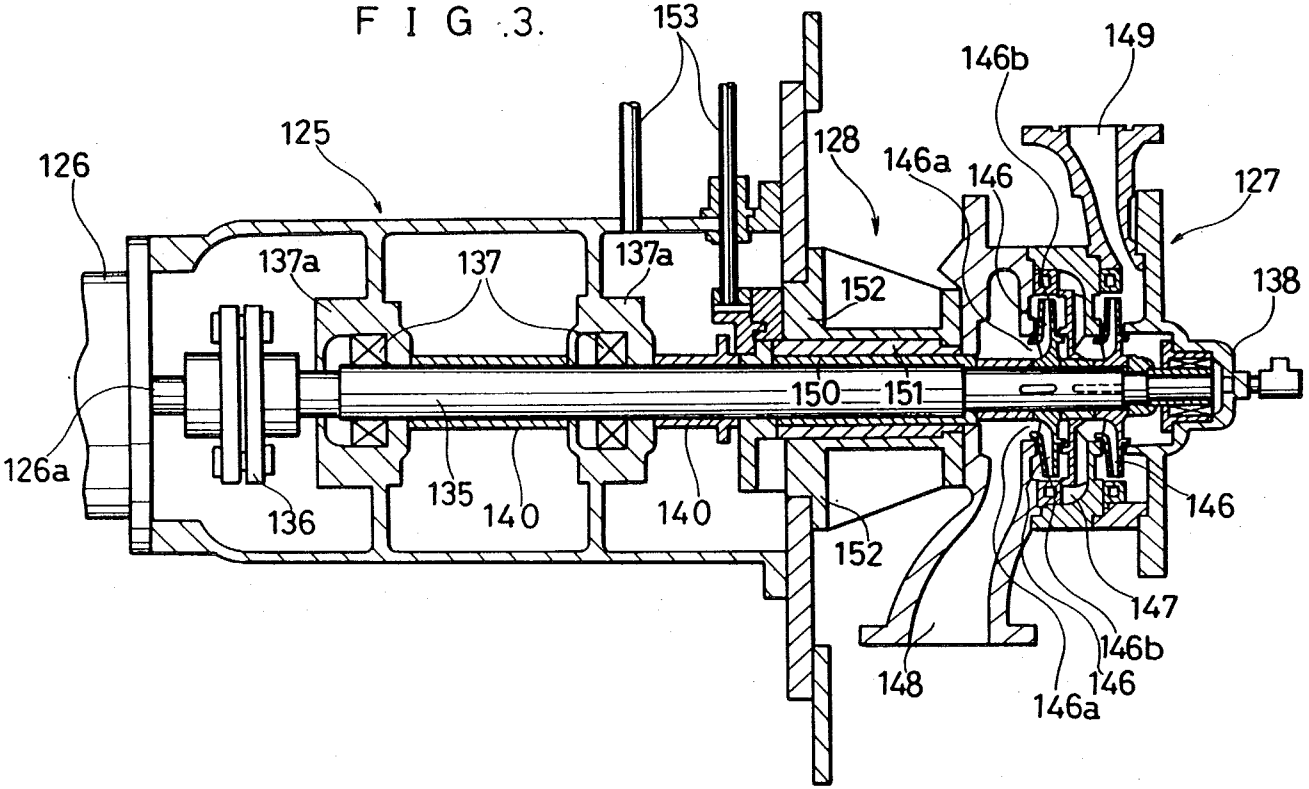
FIG. 3 is a sectional elevation view of the same pump.

Referring to FIG. 1, which shows a preferred embodiment of the invention, the oxygen gas production apparatus according to the present invention comprises an air compressor 9, a drain separator 10, a Freon cooler 11 and a couple of adsorption columns 12. This couple of adsorption columns are respectively packed with molecular sieves which exhibit a high adsorptive capacity at low temperature. These columns are alternately used for adsorption and subjected to regeneration. Thus, while one adsorption column 12 is adsorbing $H_2O$ and $CO_2$ from the air compressed by said air compressor 9 and chilled by said Freon cooler 11, the other adsorption column 12 is subjected to the regeneration of its adsorbent. The oxygen gas production apparatus of the present invention further includes a first heat exchanger 7 which receives the compressed air stripped of $H_2O$ and $CO_2$ by said adsorption column 12 via a compressed air supply pipe 8. The compressed air fed to this heat exchanger 7 is chilled to a cryogenic temperature as the result of heat exchange. The apparatus further includes a fractionation column 13, with its lower column segment being indicated at 15. It is so constructed that the compressed air chilled to a cryogenic temperature in the first heat exchanger 7 by the refrigeration produced by an expansion turbine 31 and supplied through the pipe 8 is brought into counter-current contact with a downcoming reflux fluid produced by a condenser 17 so that oxygen-rich liquefied air 18 is pooled in the bottom while nitrogen alone is held in gaseous state in the top. Indicated at 14 is a top column segment of the fractionation column 13 and said condenser 17 is disposed within this top column segment. To this condenser 17 is fed a portion of the nitrogen gas pooled in the top of the bottom segment 15 of the fractionation column 13 via a pipe 24, where the nitrogen gas is liquefied and fed, as said reflux fluid, into a liquid nitrogen basin 26 in the bottom column segment 15 via a pipe 25. The interior of said top column segment 14 is kept decompressed relative to the interior of the bottom column segment 15, so that the liquefied air ($N_2$: 50–70%; $O_2$: 30–50%) 18 in the bottom of said bottom column segment 15 flows via a pipe 21 to a second heat exchanger 21*a*, whereby it is cooled, and further to an expansion valve 20 for adiabatic expansion, where by the low-boiling nitrogen fraction is gasified while the oxygen fraction in liquid state is pooled in the bottom of the top column segment 14. Indicated at 19 is a liquid level detector-controller which controls the opening and closing of said expansion valve 20 according to the amount of liquefied air in the bottom of said bottom column segment 15. The reference numeral 28 represents a second line for withdrawing the nitrogen fraction (purity not so high) pooled in the top of the top column segment 14 as a waste nitrogen gas and guiding this waste nitrogen gas to the first heat exchanger 7 to chill the material air to a cryogenic temperature, with the waste nitrogen gas which has thus undergone heat exchange being released into the atmosphere as indicated by the arrowmark A. The lower portion of said top column segment 14 is supplied with liquid oxygen from the liquid oxygen storage tank 23 as a refrigerant via a first line pipe 23*a* and this liquid oxygen cools the built-in condenser 17 along with the liquid oxygen formed within the top column segment 14. The above-mentioned liquid oxygen storage tank 23 is supplied with liquid oxygen from an external source such as a tank trailer through a pipe 27. Indicated at 27*a* is a control valve disposed in said first line pipe 23*a* and controlled by the liquid level detection-controller 22*a*. Thus, this control valve 27*a* is such that its degree of opening is varied by said liquid level detection-controller 22*a* in accordance with the liquid level of liquid oxygen 22 collected in the bottom of the top column segment 14. Thus, as the liquid level of liquid oxygen 22 drops below a predetermined level, the opening of the valve 27*a* is expanded to increase the flow of liquid oxygen from said liquid oxygen storage tank 23. On the other hand, as the liquid level rises beyond said predetermined level, the valve opening is diminished to decrease the flow of liquid oxygen so that the liquid level of liquid oxygen 22 will be maintained at the predetermined level. Indicated at 29 is a second line for withdrawing the nitrogen gas collected in the top of the bottom column 15 and guiding it to the first heat exchanger 7. This second line 29 and said second pipe 28 are similar in the sense that they guide the nitrogen gas within the fractionation column 13 to the first heat exchanger 7. The reference numeral 30 represents a pipeline by which the waste nitrogen gas fed to the first heat exchanger 7 via said second line 29 is withdrawn from an intermediate stage of the first heat exchanger 7 and the waste nitrogen gas thus withdrawn is fed to the expansion turbine 31. This expansion turbine 31 is of the conventional type, which causes the withdrawn waste nitrogen gas to undergo adiabatic expansion to generate a refrigeration and this nitrogen gas as it is allowed to converge with the waste nitrogen gas flowing in the second line 29, whereby it is chilled to an extremely low temperature for feed to the first heat exchanger 7 again. The reference numeral 32 is a liquid oxygen withdrawal line, one end of which communicates with the top column segment 14 at a position above its bottom, for feeding the liquid oxygen collected in the bottom of the top column segment 14 to a liquid oxygen pressurizing pump 33. This pressurizing pump 33 is adapted to pressurize the oxygen in liquid state to a predetermined pressure and, as illustrated in FIG. 2, comprises a motor mount 125, a high-speed motor 126 mounted thereon, and a compression unit 127 mounted on the lower side of said mount 125 through a liquid oxygen leak seal 128. More specifically, as shown in FIG. 3, the pump includes a main shaft 135 which extends through the center of said motor mount 125, liquid oxygen leak seal 128 and compression unit 127 and is connected to a rotary shaft 126*a* of said motor 126 via a coupling 136. This main shaft 135 is rotatably supported by a bearing means 137 secured in position by a bearing cover 137*a* disposed within the motor mount 125 and a bearing 138 disposed at the end of the compression unit 127. The reference numeral 140 represents a sleeve. The compression unit 127 comprises a couple of spiral impellers 146 mounted on said main shaft 135 in upper and lower positions and a casing for accommodating the impellers 146. By the rotation of the main shaft 135, liquid oxygen is taken into a central suction port 146*a* of the impeller 146 and discharged in pressurized state from a peripheral discharge port 146*b*. Thus, as the impellers 146 are driven, the liquid oxygen is taken into a suction nozzle 148, pressurized by the first-stage impeller 146 and, after passage through a passageway 147, further pressurized by the second-stage impeller 146, whereby the liquid oxygen is compressed to a predetermined pressure.

The liquid oxygen leak seal 128 comprises a sleeve 150 surrounding said main shaft 135, a labyrinth 151 disposed around said sleeve 150 and a labyrinth cover 152 disposed further on said labyrinth 151, and serves to prevent leakage of liquid oxygen from the compression unit 127 and entry thereof into the motor mount 125 to cause an explosion. In this connection, said motor mount 125 is divided into three gas-tight compartments so that liquid oxygen which may leak out will not reach the motor. The reference numeral 153 is an oxygen exhaust pipe which discharges liquid oxygen in gaseous state so that even if liquid oxygen leaks out from said seal 128, it will not reach the motor as it is. Referring to FIG. 1, the reference numeral 34 represents an oxygen transport pipe for feeding the liquid oxygen pressurized by said pressurizing pump 33 to the first heat exchanger 7 through said second heat exchanger 21*a*. Indicated at 35 is the product oxygen withdrawal pipe for sending out the product oxygen gas at atmospheric temperature from the first heat exchanger 7.

The reference numeral 36 represents a backup system line which opens a valve 36*a* in the event of a failure of the air compression system line, whereby the liquid oxygen in the liquid oxygen storage tank 23 is vaporized in an evaporator 37 and sent into the pipe 35 so as to prevent interruption of oxygen gas feed. Indicated by a dot-broken line is a vacuum cold housing which prevents entry of heat from outside for a further improvement of purification efficiency.

With the gas production apparatus described above, product oxygen gas is produced in the following manner. Thus, material air is compressed by the air compressor 9 and freed of water vapor in the drain separator 10. The moisture-free air is chilled by the fleon cooler 11 and fed to the adsorbent column 12, where $H_2O$ and $CO_2$ are removed by adsorption. Then, the compressed air freed of $H_2O$ and $CO_2$ is fed to the first heat exchanger, wherein it is chilled to a cryogenic temperature, and fed as it is to the bottom column segment 15 of the fractionation column 13. Then, this compressed air is subjected to counter-current contact with the overflowing liquid nitrogen from the liquid nitrogen basin 26 to liquefy a portion thereof and the resulting liquefied air 18 is collected in the bottom 15 of the bottom column segment 15. In this process, by the difference in boiling point between nitrogen and oxygen (oxygen boils at −183° C. and nitrogen boils at −196° C. at atmospheric pressure), the higher-boiling oxygen fraction of the compressed air is liquefied, while the nitrogen fraction remains gaseous. This remaining gaseous nitrogen is withdrawn via a second line 29 and sent to the first heat exchanger 7. When its temperature has increased to about −140° C., the nitrogen is withdrawn through a line 30 and fed to the expansion turbine 31. The nitrogen gas fed into the expansion turbine generates the refrigeration on adiabatic expansion and converges with the waste nitrogen gas fed from the top column 14 through the second pipe 28. In the first heat exchanger 7, the nitrogen gas undergoes heat exchange with the compressed air to thereby cool the latter to a cryogenic temperature. On the other hand, the oxygen-rich liquefied air 18 collected in the bottom of the bottom column 15 is further chilled in the second heat exchanger **21*a* and, then, fed in a mist form into the top column segment 14 from a pipe 21 equipped with an expansion valve 20. As the liquefied air 18 is thus charged into the top column segment 14, the nitrogen fraction is gasified and collects in the top, while the oxygen fraction is liquefied and flows down to the bottom where it is pooled as liquid oxygen 22. The liquid oxygen thus collected in the bottom is withdrawn by the liquid oxygen withdrawal line 32, pressurized by the liquid oxygen pressurizing pump 33 and subjected to heat exchange in the second heat exchanger 21*a* and first heat exchanger 7. The resulting product oxygen gas at atmospheric temperature is sent out via the withdrawal pipe 35**. In the above manner, oxygen gas of high purity is manufactured.

Particularly, this apparatus is capable of adapting itself quickly to variations in the demand for product oxygen gas while maintaining its purity at a constant level and this is the most outstanding feature of the invention. Thus, a sharp increase in the demand for product oxygen gas results in a decrease in the pooled amount of liquid oxygen 22 in the top column segment 14 whereby its liquid level is brought down below a predetermined level. Then, the liquid level detection-controller **22*a* immediately senses the lowed liquid level and increases the degree of opening of the control valve 27*a*. As a result, an increased amount of liquid oxygen is supplied from the liquid oxygen storage tank 23 into the top column segment 14, whereby the liquid level of liquid oxygen 22 in the top column segment 14 is elevated to the predetermined level. When the demand for product oxygen gas decreases, the reverse of the above sequence takes place. As the liquid level of liquid oxygen 22 is thus controlled at a predetermined level at all times, the amount of reflux fluid produced by the condenser 17 is optimized so that the whole apparatus functions properly. Therefore, high-purity product oxygen gas can be sent out from the pipe 35** at a rate appropriate to the demand without variation in purity.

In that manner, the oxygen gas production apparatus of this example is able not only to produce highly pure oxygen gas but also to cope smoothly with major and rapid changes in the demand for the product oxygen gas as the liquid oxygen supply from the liquid oxygen storage tank 23 is controlled by means of the liquid level detection-controller **22*a* and the valve 27*a* to thereby increase or decrease the rate of oxygen gas generation while the cooling capacity of the expansion turbine 31** is kept constant. Furthermore, since the product oxygen gas is sent out in a pressurized state for smooth supply of the product oxygen gas and for the convenience of consumers in using the same and the pressurization is effected in a liquid state, not in a gaseous state, the pressurization efficiency is high in this embodiment and therefore the pressurization can be achieved with small power requirements. While a gas occupies a space as large as 22.4 liters per mole and requires a large-scale apparatus for the pressurization thereof, a liquid is smaller in volume as compared with gases, so that it is relatively easy to pressurize it. In particular, when in a gaseous state, oxygen is highly active and readily reacts with lubricating oils in the pressurizing pump and with other substances to thereby cause an immediate explosion. On the contrary, when oxygen is in a liquid state, such a situation can be obviated and the use of liquid oxygen has a further advantage in that pumps can be sealed more readily and simply than the case when gaseous oxygen is used.

While, in the above embodiment, the control valve **27*a* is controlled by the liquid level detection-controller 22*a*, it is also possible to use a check valve in place of the control valve 27*a* and control the opening and closing of said check valve by means of the liquid level detection-controller 22*a***.

I claim:

1. An oxygen gas production apparatus comprising an air compression means for compressing air from an outside source, a purification means for removing carbon dioxide gas and water vapor from the air compressed by said air compression means, a heat exchange means for chilling the compressed air from said purification means to a cryogenic temperature, a fractionation column for liquefying and fractionating the compressed air chilled to a cryogenic temperature by said heat exchange means and holding nitrogen in gaseous state and oxygen in liquid state, a liquid oxygen storage means for receiving liquid oxygen from an outside source and storing the same, a line for introducing into said fractionation column the liquid oxygen from said liquid oxygen storage means as the refrigerant for liquefaction of compressed air, a liquid level detection-control means for monitoring the liquid level of oxygen held in said fractionation column and controlling the amount of feed of liquid oxygen from said liquid oxygen storage means in response to changes in said liquid level, a second line for guiding gaseous nitrogen in said fractionation column to said heat exchange means as a refrigerant, an expansion means for cooling the gaseous nitrogen in said second line by the principle of adiabatic expansion, and an oxygen gas withdrawal line for guiding the liquid oxygen in said fractionation column to said heat exchange means as a refrigerant and withdrawing the gaseous oxygen produced by heat exchange as a product oxygen gas.

* * * * *

UNITED STATES PATENT AND TRADEMARK OFFICE

CERTIFICATE OF CORRECTION

PATENT NO. : 4,732,595

DATED : March 22, 1988

INVENTOR(S) : Akira YOSHINO

It is certified that error appears in the above-identified patent and that said Letters Patent is hereby corrected as shown below:

On the cover page, in section [56], References Cited, after the U.S. patent documents add:

--FOREIGN PATENT DOCUMENTS 0102190 3/1984 European Pat. Off.

OTHER PUBLICATIONS

Chemical Abstracts, Vol. 101, No. 22, Nov. 1984, P. 143, abstract No. 194579t.--.

Signed and Sealed this

Sixth Day of September, 1988

*Attest:*

*Attesting Officer*

DONALD J. QUIGG

*Commissioner of Patents and Trademarks*